United States Patent [19]

Mackey et al.

[11] Patent Number: 4,544,141

[45] Date of Patent: Oct. 1, 1985

[54] PROCESS AND APPARATUS FOR CONTINUOUS CONVERTING OF COPPER AND NON-FERROUS MATTES

[75] Inventors: Phillip J. Mackey, Pointe Claire; J. Barry W. Bailey, Noranda, both of Canada

[73] Assignee: Noranda Inc., Toronto, Canada

[21] Appl. No.: 685,235

[22] Filed: Dec. 21, 1984

Related U.S. Application Data

[62] Division of Ser. No. 490,021, Apr. 29, 1983, Pat. No. 4,504,309.

[30] Foreign Application Priority Data

Jun. 18, 1982 [CA] Canada ..... 405473

[51] Int. Cl.[4] ..... C21C 5/42

[52] U.S. Cl. ..... 266/215; 75/72

[58] Field of Search ..... 266/215, 161, 212; 75/72

[56] References Cited

U.S. PATENT DOCUMENTS

| | | | |
|---|---|---|---|
| 2,668,107 | 2/1954 | Gordon | 75/72 |
| 3,988,148 | 10/1976 | Queneau | 75/72 |
| 4,005,856 | 2/1977 | Themelis | 266/161 |
| 4,200,265 | 4/1980 | Berndt | 266/215 |
| 4,236,700 | 12/1980 | Makipirtti | 266/161 |

*Primary Examiner*—Peter D. Rosenberg

*Attorney, Agent, or Firm*—Schwartz, Jeffery, Schwaab, Mack, Blumenthal & Evans

[57] ABSTRACT

A continuous process and apparatus for converting non-ferrous mattes is disclosed. The process comprises feeding continuously or intermittently a liquid matte into a furnace while continuously blowing air, oxygen or oxygen-enriched air into the melt contained in the furnace at a rate in balance with the rate of liquid feed matte and the desired degree of oxidation, introducing flux into the furnace at a rate in balance with the feed matte and air, oxygen or oxygen-enriched air, and removing slag from the top of the melt and a refined product from beneath the melt while continuously blowing air, oxygen or oxygen-enriched air through the melt.

9 Claims, 1 Drawing Figure

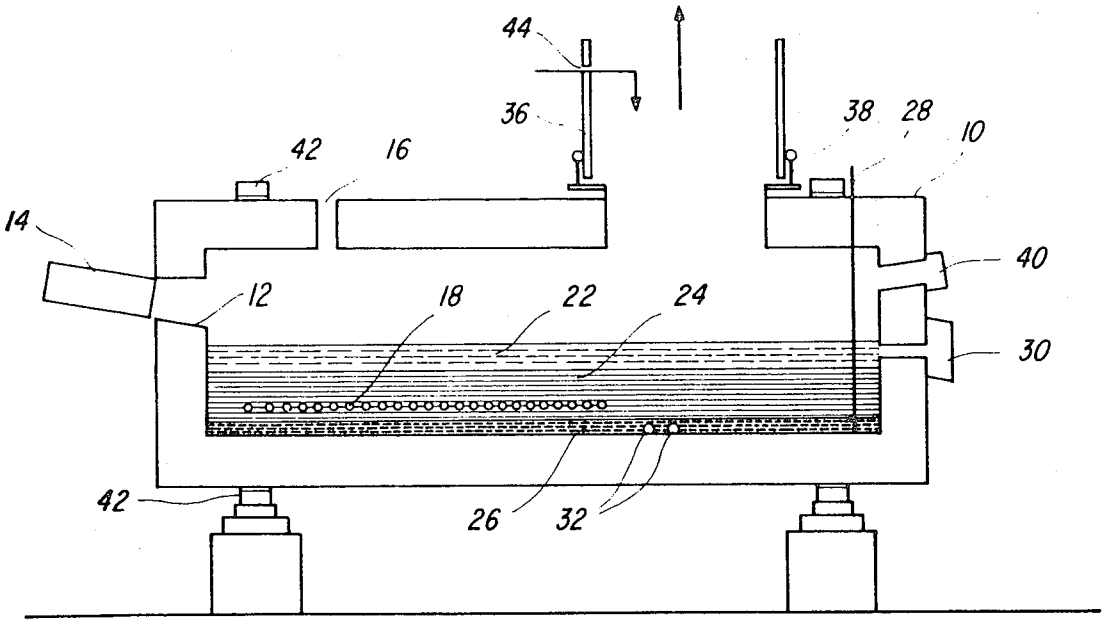
10
28
38
40
30
44
36
24
22
18
16
42
12
14
32
26
42

PROCESS AND APPARATUS FOR CONTINUOUS CONVERTING OF COPPER AND NON-FERROUS MATTES

This is a division of application Ser. No. 490,021, filed Apr. 29, 1983 and now U.S. Pat. No. 4,504,309.

This invention relates generally to the converting of non-ferrous mattes and metals and more particularly to a process and an apparatus for continuous converting of copper mattes.

Copper and copper-nickel production processes generally involve the smelting of concentrates and fluxes in a reverberatory furnace or flash furnace as in U.S. Pat. No. 2,668,107 or Canadian Patent No. 851,099, or the continuous smelting process described in U.S. Pat. No. 4,055,156, wherein two phases are produced—a matte phase consisting of metal sulphides and a slag. The slag may be cleansed of its metal content and discarded while the sulphide matte is removed and transported to a second vessel for converting.

In the converting of non-ferrous metals, it is common practice to remove iron, sulphur and some of the impurities present in the initial matte produced by smelting by treatment of the melt in a two-stage oxidation process in a vessel called a converter by means of air forced into the melt by way of a number of openings or tuyeres in the furnace shell. The converter vessel most widely used in the non-ferrous industry is a barrel furnace mounted on rollers with the openings or tuyeres located horizontally along the side of the barrel and a main opening called the mouth on an upper side of the barrel for discharging the off gas, for charging the vessel and for pouring out or skimming the refined charge. The location of the openings or tuyeres is such that they are submerged under the metal or melt whilst the process is being carried out and raised above the melt while the process is stopped for skimming or charging. This type of converter is referred to as the Peirce-Smith converter.

Reaction off-gases are drawn through the mouth of the vessel and leave via a special hood placed over the mouth for directing the off-gases into a device for gas cooling, such as a waste heat boiler or an evaporative cooler, followed by gas cleaning processes. Because of the requirement to rotate the vessel about its longitudinal axis for charging and skimming and back to the blowing position with the tuyeres submerged, a gap is required between the fixed hood and the vessel. This gap is a source of considerable air infiltration which dilutes the off-gas stream, increasing its volume considerably thereby requiring larger sized equipment for gas treatment. In older plants the diluting air also served as a means to cool the gas before it entered the hood and the off-gas flue, which was usually fabricated of mild steel. This need for cooling by dilution imposed by the materials of construction of the gas system has been overcome by the use of water cooled hoods or by cast-steel hoods.

Another converter design is the Siphon converter which is a horizontal furnace equipped with a special siphon hood to minimize air dilution at the mouth of the vessel.

The presently used converter process for copper smelting is a two-stage batch operation. Matte is charged to the converter via ladles pouring through the mouth, and when ready, the vessel is rotated to blowing position and the melt is oxidized with air while siliceous flux is added. Iron sulphide is oxidized in the first stage to form a slag and sulphur dioxide gas while, in the second stage, copper sulphide is oxidized to form blister-copper and sulphur dioxide gas. In the first stage referred to as the slag blow, the following typical reaction occurs:

$$FeS + 1\tfrac{1}{2}O_2 = FeO + SO_2$$

The iron oxide reacts with the silica flux to form an iron-silicate slag as follows:

$$2FeO + SiO_2 = 2FeO.SiO_2$$

The slag contains entrained copper matte and some dissolved copper oxide. Some iron oxide may be oxidized further to magnetite ($Fe_3O_4$) which dissolves in the slag. Under certain conditions excess magnetite may be produced causing a sticky slag.

When about half the iron has been oxidized, the process is stopped and slag is removed by pouring through the mouth into a ladle. This slag may be retreated for recovery of metals. It may be returned to the smelting furnace or treated by milling and flotation. A second charge of matte is then made to the converter and the process repeated. This cycle is repeated several times until all the iron has been oxidized and the slag has been removed. At this point, the second stage (called the copper blow) commences. In this stage, the copper sulphide bath is oxidized to blister copper and sulphur dioxide gas in one cycle, and there are no matte or flux additions. The overall reaction in the second stage may be represented as:

$$Cu_2S + O_2 = 2Cu + SO_2$$

When all the sulphur has been oxidized, the process is stopped and blister copper is poured into ladles and the converter is ready for the next cycle.

A similar type of operation is carried out for the converting of nickel or copper-nickel mattes except the second stage is omitted and the final product is normally a refined matte. This product is usually referred to as "Bessemer" matte and is typically 75–80% Ni+Cu and 20% S with perhaps 0.5–2% Fe.

A typical Peirce Smith cycle for the treatment of 30–40% Cu matte would proceed as follows, starting with an empty converter:

1st Blow:
Add 3 ladles of matte,
Start blowing,
Adjust flux rate to control temperature,
Stop blowing to add reverts,
Resume blowing,
Stop blowing to add 1 ladle matte,
Add flux, total 14–20 tonnes,
Raise the temperature,
Skim 4 ladles of slag.

2nd Blow:
Add 1 ladle of matte,
Start blowing,
Adjust flux rate to control temperature,
Stop blowing to add 1 ladle of matte,
Resume blowing,
Add flux,
Stop blowing to add 1 ladle matte,
Resume blowing,
Add flux, total 15–24 tonnes, Raise the temperature,
Skim 4 ladles of slag.
3rd Blow:
Add 1 ladle of matte,
Start blowing,
Adjust flux rate to control temperature,
Stop blowing to add 1 ladle matte,
Resume blowing,
Add flux,
Stop blowing to add 1 ladle matte,
Resume blowing,
Add flux, total 18–24 tonnes,
Raise the temperature,
Skim 3 ladles of slag.
Going High*:
Resume blowing,
Add 2 tonnes flux,
Raise the temperature,
Skim 1 ladle of slag.

*final blow before copper blow

Copper Blow:
Add four or five cold copper pigs during blow, each time turning in and out of stack.
End copper blow, pour 85 tonnes of blister copper.

The total blowing time is 6 to 7 hours for a blowing rate of 47,000 $Nm^3/h$, on a total elapsed time of 8 to 9 hours. The converter is turned into and out of the blowing position 15 to 20 times. The converter off-gas in the flue contains 2 to 5% $SO_2$ during the slag blow and somewhat higher during the copper blow. The gas strength is largely a function of the amount of dilution by air drawn in at the mouth. This diluting air enters at the gap which is maintained between the vessel and the hood to allow free and unencumbered movement of the vessel when rotating to and from the blowing position. It has not been found possible to form an effective seal in this area on account of the extremely high temperatures and the almost constant motion of the vessel in turning back and forth in the cycle.

The cycle follows a similar pattern for higher matte grades except there is less flux addition per tonne of matte and less slag is produced. The number of times the converter is turned into and out of the blowing position is also reduced.

Fugitive emissions are one of the most undesirable features of converter operations and such emissions around the converter occur each time the converter is turned into and out of the blowing position. This feature remains a fundamental deficiency of the conventional converter process. Engineering designs to minimize these fugitive emissions are complex and expensive.

A typical converter aisle may comprise two, three or more converters aligned on one side of the building with the smelting furnace, which provides matte, usually on the opposite side; however the furnaces may be located on the same side as the converters. Matte is transported in ladles from the smelting furnace to the converters. Converter slag is returned to the smelting furnace using ladles or the slag may be removed from the converter aisle for slow cooling for copper recovery by milling and flotation.

The batch-operated converter process as used in existing smelters has the following major drawbacks:

1. A discontinuous, high volume off-gas that considerably increases the costs of gas handling and $SO_2$ fixation. The discontinuous flow of off-gas is a result of stopping to skim slag or refined melt product and add feed matte. The number of times the converter must be turned into and out of the stack leads to deterioration of the effectiveness of the seal at the gap between the hood and the vessel. This causes unfiltrating air to enter the off-gas stream, adding to the total off gas volume.
2. High levels of fugitive and random gas emission. These emissions occur during the following operations:
   pouring matte into the converter,
   turning the converter to stop or start the process,
   tapping or skimming the converter of slag or refined melt product.
3. Low productivity due to stoppages for pouring matte, skimming melt products and associated delays arising from constraints, crane and materials handling and scheduling. It is not uncommon for a converter to be idle and non-productive for 30–60% of the time; and operating time of 70% (or 30% idle time) is considered extremely efficient.

Thus the productivity of the conventional converter process is low. When measured as the specific productivity in terms of tonnes of matte processed per cubic meter of converter volume per hour, the productivity is typically 0.36 to 0.42 for mattes containing 30–40% Cu and 1.2 to 1.8 for mattes containing 70 to 80% Cu.

Several processes have been developed to replace the smelting and converting apparatus with a single vessel and thus eliminate the above mentioned two-stage batch converting operation. Examples are the process for continuous smelting and converting of copper concentrates described in Canadian Pat. No. 758,020 or the device for suspension smelting of finely divided oxide and/or sulphide ores and concentrates described in U.S. Pat. No. 4,236,700. Any and all of these processes are generally restricted to the treatment of copper concentrates low in certain heavy metals, notably those elements from Group Va of the periodic table since according to well-established physico-chemical laws, these elements have a greater affinity for metallic copper than the sulphide phase and if present in the concentrate will therefore tend to be dissolved into the copper so produced. Thus, existing continuous smelting and converting processes cannot be applied to concentrates containing high concentration of certain heavy metals without affecting the quality of the blister copper. In such cases, it is common practice to produce a matte, generally a high-grade matte, rather than metallic copper and convert this matte in the existing batch processes. More than 80% of the world's copper produced by smelting sulphide concentrates is processed by matte smelting and conventional converting.

A number of investigators have also proposed a variety of ways and means for rectifying the problems associated with conventional batch converting process. These include the work by D. A. Diomidovskii et al. (Continuous Converting of Matte, Soviet Metal Technology, 1959, pages 75–85), F. Sehnalek et al. (Continuous Converting of Copper Mattes, Journal of Metals, Volume 16, pages 416–420, 1964), and T. Suzuki and K. Tachimoto in Canadian Pat. No. 1,015,943 (Continuous Process for Refining Sulfide Ores). Only the last named process is practiced on a large scale commercial process. Despite these efforts, none have satisfactorily overcome the obstacles involved; they still retain several disadvantages of the established art and introduce new restrictions.

In the first two reports, it was proposed to use high pressure lances rather than tuyeres to introduce air. The utilization efficiency of the lance air was hindered by splashing of the molten bath and this imposed a process throughput limitation on the process. The average air utilization efficiency was about 80% which is lower than in the conventional converting process. The overall specific productivity of the process is low, about 0.18 to 0.36 tonnes per cubic meter per hour, less than for the conventional process.

The patented third process (Canadian Pat. No. 1,015,943) includes a description of a converting process intended to overcome the problems associated with conventional converting. The patent refers to three separate but communicating, individual furnaces for continuous smelting, converting and slag cleaning. It also relies on lances blowing air on to the slag surface to oxidize the melt in a stationary converter furnace. As with the two previously referred to top blowing processes, the efficiency of the top blowing lances is normally 85–90% which is lower than in conventional converters equipped with tuyeres. The lancing rate and the oxidation efficiency of the air injected through the lances is affected by the thickness and quality of the slag layer and the resultant splashing. In this process, the copper product is removed using a siphon and slag is removed by an overflow weir. The limit on the matte grade entering the process from the special smelting furnace is up to about 70% Cu. The specific productivity of the converting process is about 0.15 tonnes per cubic meter per hour which is lower than for the conventional process. In the converting process there are two layers, a lime-ferrite slag and metallic copper with the matter layer being absent. Incoming matte is oxidized by a different reaction involving copper oxide. The process needs a continuous flow of molten matte of constant grade, which requires complex control procedures for all input and output materials, making the process sensitive to upsets. The above features mean that the process is difficult to mate with any smelting process other than that also described in Canadian Pat. No. 1,015,943.

The above process thus has many disadvantages and limitations affecting its application.

It is therefore the object of the present invention to provide a process and an apparatus for continuous converting of copper and non-ferrous mattes that will replace with advantage the conventional batch type two-stage converter process and apparatus, and eliminate the above listed drawbacks of the existing process.

The continuous converting process, in accordance with the present invention, comprises feeding continuously or intermittently liquid matte into a horizontal generally elongated furnace while at the same time continuously blowing air or oxygen or oxygen-enriched air into the melt through tuyeres submerged below the melt surface and at a rate in balance with the rate of liquid feed matte and the desired degree of oxidation, introducing flux into the furnace at a rate in balance with the feed matte and air, oxygen or oxygen-enriched air, and removing slag from the top of the melt and a refined product from beneath the melt while continuously blowing air, oxygen or oxygen-enriched air through the melt.

The process may be used to produce blister copper or white metal from a copper-iron sulphide matte, or Bessemer matte from a copper-nickel or nickel matte, or in general, a refined matte or metal from a non-ferrous metal-containing sulphide matte, such non-ferrous metal being selected from a group consisting of copper, nickeliferous copper, cobaltiferous copper, cobaltiferous nickel and cobaltiferous copper nickel.

The apparatus, in accordance with the present invention comprises a horizontal generally elongated furnace having means for continuously or intermittently introducing a liquid feed matte into the furnace, a set of tuyeres along one side of the furnace for continuously blowing air, oxygen or oxygen-enriched air into the melt at a rate in balance with the rate of liquid feed matte and the desired degree of oxidation, means for introducing flux into the furnace at a rate in balance with the feed matte and air, oxygen or oxygen-enriched air, an off-gas port, a first discharge port at the end away from the tuyeres for removing slag from the top of the melt while air, oxygen or oxygen-enriched air is continuously blown through the melt, and a second discharge port for removing a melt product from beneath the melt while air, oxygen or oxygen-enriched air is continuously blown through the melt.

Means may be provided, if required, to maintain the operating temperature, for the addition of fuel as solid, liquid or gas into the furnace. Means may also be provided to add metal scrap as coolant or as a way of recycling such scrap.

Holding means are generally provided whereby the molten slag may be removed and cooled and returned to the smelting furnace or treated by pyrometallurgical cleaning or milling. Similarly, holding means are provided for removing the refined product for further treatment.

The liquid matte and the flux are preferably introduced into the furnace through one or separate charging ports located at one end of the furnace. Alternatively, the liquid matte and flux may be added through the off-gas port.

The invention will now be disclosed, by way of example, with reference to a drawing which illustrates an embodiment of a continuous converter in accordance with the invention.

Referring to the drawing, there is shown a converter in the shape of a horizontal generally elongated cylindrical barrel type furnace 10. A charging port 12 is provided at one end of the furnace to introduce a knwon amount of liquid feed matte and flux either continuously or intermittently via a launder 14. A second charging port 16 may be provided in the furnace for adding fluxes which may be in any size convenient for handling such as in crushed or pulverized forms. This second charging port 16 may also be used to add additional materials to the melt, such as copper containing reverts, scrap or slag concentrate.

A row of tuyeres 18 is located on the lower part of the barrel. The tuyeres are spaced more or less evenly along the length of the converter where the matte is added; the number of tuyeres and the tuyere spacing is influenced by the volume of air, oxygen or oxygen-enriched air required. Air or oxygen or oxygen-enriched air is blown through the tuyeres at a controlled amount in a ratio to the rate of feed matte addition. The tuyere action generates intense mixing in the furnace, allowing rapid assimilation of the liquid feed matte, fluxes and other solid materials, and resulting in the formation within the molten bath of three phases, when metallic copper is being produced, consisting of a slag phase 22, a white metal sulphide phase 24 and a metallic copper phase 26. When an enriched matte is the end product, e.g. Bessemer matte comprising copper and nickel sulphide, the metallic copper phase 26 is absent and there are two phases 22 and 24 present in the furnace. The level of each phase in the converter furnace is measured periodically, for example by a dipstick 28, or other means. The levels are maintained at predetermined values by tapping and by adjusting the ratio of the oxygen supplied to the amount of liquid feed matte. The flux feed rate is automatically controlled at a preset ratio to the liquid feed matte rate and the oxygen rate. The level set point for each phase may be varied over wide limits. The tuyeres normally blow into the sulphide matte phase 24 and are placed at a sufficient depth in the matte phase to allow a constant and high utilization efficiency of the injected oxygen.

A slag tapping hole 30 is located at the end of the furnace away from the tuyeres 18. This slag tapping hole is provided for continuous or intermittent tapping of slag phase 22 while the tuyeres are blowing. A separate holding means (not shown) is normally provided whereby the molten slag may be removed for cooling and returned to the primary smelting furnace or for pyrometallurgical cleaning to recover the metal contained therein. Tapping holes 32 are provided for tapping the product such as the metallic copper phase 26 or the metal sulphide phase 24. A separate holding means (not shown) is normally provided whereby the refined product may be removed for further treatment.

The oxidation of the feed matte to produce the desired product produces a steady stream of sulphur dioxide gas which is exhausted from the vessel, along with the other off gases such as nitrogen or carbon dioxide, through an off-gas port or mouth 34 which is covered with a hood 36 when the furnace is in blowing and/or standby position. The hood 36 may be fitted with flaps 38 or other means of sealing the junction of the hood 36 and the vessel 10 to limit the ingress of air into the off-gas stream. As the continuous converter in the present invention is not required to turn out of the blowing position for matte charging or skimming the melt, the integrity of this seal can be maintained. The off-gases are cleaned, cooled and treated in an $SO_2$ recovery system according to known art.

The process is normally autogenous but if it is required to increase operating temperature depending on vessel size, blowing rate, matte grade, and the amount of cold scrap and reverts added, a small amount of fossil fuel may be added. For this purpose, burners may be inserted through suitable ports, such as port 40, at one end or both ends of the furnace. If required, part or all of such fuel may be injected in the form of a liquid jet, spray, or as solid fuel or as a gas jet through charging ports 12 or 16. Ports 12 and 16 are provided with a means of closure, such as flaps or air curtain seal, between periods of charging. Flux may also be charged via port 44 in the hood 36. Liquid matte may also be added through mouth 34.

During operation, liquid feed matte is added continuously or intermittently while at the same time, air or oxygen or oxygen-enriched air is continuously blown through the tuyeres 18 at a controlled rate relative to the rate of feed matte. Fluxes or other materials, as required, are also fed into the furnace at a rate which is automatically controlled to the liquid feed matte rate and the oxygen rate. Small changes in the air flowrate are not detrimental to the process. It is, however, the continuous nature of the present invention with continuous blowing, while at the same time conducting periodic or continuous matte addition, with slag tapping and refined product tapping during blowing which distinguishes the present converting process from the conventional process used in the industry today. Such conventional process is characterized by separate matte charging and blow cycles followed by stopping the process for skimming the slag produced in each cycle and re-charging with matte. At the end of the cycle, the process must be stopped for pouring out the refined product.

The continuous converting process and apparatus in accordance with the present invention is also different from the continuous smelting and converting process and apparatus as disclosed in the above mentioned U.S. Pat. Nos. 4,005,856 and 4,236,700 wherein both smelting and converting are done in the same vessel. The process in accordance with the present invention is not concerned with concentrate smelting but with the continuous converting of the liquid matte.

The apparatus of the present invention is not limited to any particular size or shape of converter furnace; however, one resembling an elongated cylindrical-shaped furnace, similar to a Peirce-Smith converter is preferred. It is also possible to modify an existing Peirce-Smith converter to the apparatus of the present invention by installation of the appropriate feed ports and tap holes.

The furnace in accordance with the present invention is also provided with riding rings 42 to allow rotation of the tuyeres out of the melt if, for any reason, it is needed to stop the furnace.

Specific examples of preferred procedures will now be given to illustrate the invention in more detail:

EXAMPLE 1

Four hundred and ninety five metric tonnes per day of copper matte analyzing 73% Cu, 2.5% Fe and 20% S, are fed into a continuous converter constructed and operated in the manner indicated in FIG. 1, and are continuously and autogenously converted with 16,100 normal cubic meters of tuyere air. Eight metric tonnes of flux per day analyzing 95% $SiO_2$ are added. The rates of both tuyere air and matte are controlled and three hundred and sixty five metric tonnes of copper per day are produced containing over 98% Cu and 1.5% S for tapping beneath melt while blowing air through the tuyeres as indicated on FIG. 1. The molten slag produced by the process contains 27% $SiO_2$ and 43% Fe and is removed by tapping while blowing. The off-gas from the converting operation is discharged continuously at a rate of 15,900 normal cubic meters per hour (dry basis) analysing 20% $SO_2$. The hot gas is diluted by air at the vessel hood to 13.4% $SO_2$.

In the above example, the specific throughput is 2.6 tonnes per cubic meter per hour.

EXAMPLE 2

A copper-nickel matte analyzing 8.6% Cu, 14.8% Ni, 44.8% Fe and 24.7% S is treated in a continuous converter similar to that described herein and shown in FIG. 1. Air is continuously injected through submerged tuyeres at the rate of 19,000 normal cubic meters per hour. There is produced (i) Bessemer matte containing 28% Cu, 47% Ni, 1.5% Fe and 22% S, (ii) a slag containing 24% $SiO_2$, 49% Fe, 0.5% Cu and 1 to 3% Ni which is treated pyrometallurgically.

The Bessemer matte is tapped beneath the melt while the tuyeres are blowing and treated for copper and nickel recovery.

We claim:

1. Apparatus for the continuous converting of nonferrous matte comprising a horizontal generally elongated furnace which is stationary during normal operation, having:

(a) means for at least intermittently introducing a liquid feed matte into the furnace throughout the converting;

(b) a set of tuyeres along one side of the furnace for continuously blowing an oxidizing gas into the melt at a rate in balance with the rate of liquid feed matte and the desired degree of oxidation;

(c) means for introducing flux into the furnace at a rate in balance with the feed matte and said oxidizing gas;

(d) an off-gas port;

(e) a first discharge port at the end away from the tuyeres for removing slag from the top of the melt while said oxidizing gas is continuously blown into the melt; and (f) a second discharge port for removing a refined product from beneath the melt while said oxidizing air is continuously blown through the melt.

2. Apparatus as defined in claim 1, further comprising means for further addition of conversion materials into the furnace.

3. Apparatus as defined in claim 1, further comprising holding means whereby said molten slag may be removed and cooled and returned to a smelting furnace or sent to cleaning.

4. Apparatus as defined in claim 1, further comprising holding means whereby said refined product may be removed for further treatment.

5. Apparatus as defined in claim 1, wherein said means for introducing liquid matte and flux in said furnace are charging ports located at one end of the furnace.

6. Apparatus as defined in claim 1, wherein the liquid matte and flux are added through the off-gas port.

7. An apparatus as defined in claim 2, wherein said conversion materials comprise scrap.

8. An apparatus as defined in claim 2, wherein said conversion materials comprise reverts.

9. An apparatus as defined in claim 2, wherein said conversion materials comprise fuel.

* * * * *